US005526883A

United States Patent [19]

Breaux

[11] Patent Number: 5,526,883

[45] Date of Patent: Jun. 18, 1996

[54] SAFETY VALVE CLOSURE SYSTEM

[75] Inventor: Dallas J. Breaux, Bogue Chitto, Miss.

[73] Assignee: Safoco, Inc., Houston, Tex.

[21] Appl. No.: 322,274

[22] Filed: Oct. 13, 1994

[51] Int. Cl.[6] ..... E21B 34/16; E21B 43/12

[52] U.S. Cl. ..... 166/373; 137/492.5; 166/53

[58] Field of Search ..... 166/53, 75.1, 373, 166/386, 379; 137/492.5, 458; 251/29

[56] References Cited

U.S. PATENT DOCUMENTS

| | | | |
|---|---|---|---|
| 3,856,037 | 12/1974 | Garrett et al. | 137/236 |
| 3,970,144 | 7/1976 | Boykin, Jr. | 166/53 |
| 4,062,379 | 12/1977 | Clinton | 166/53 X |
| 4,082,147 | 4/1978 | Wolff et al. | 166/53 X |
| 4,091,832 | 5/1978 | Snyder et al. | 137/72 |
| 4,215,746 | 8/1980 | Hallden et al. | 166/53 |
| 4,319,603 | 3/1982 | Snyder | 137/492.5 |
| 4,523,602 | 6/1985 | Snyder | 137/458 X |
| 4,774,980 | 10/1988 | Etheridge | 137/488 |

OTHER PUBLICATIONS

"Baker Oil Tools Safety Systems" brochure exerpts, pp. 38, 40, 46, 54–57 and endpage bearing date Dec. 1992.

Baker CAC printed materials "884–01 Single–well control panel" with date Nov. 1, 1981 and pp. 695, 696, 702–705.

*Primary Examiner*—Hoang C. Dang

*Attorney, Agent, or Firm*—Tim L. Burgess

[57] ABSTRACT

Apparatus and method of controlling a surface safety valve and a subsurface safety valve in a producing hydrocarbons well, comprising: providing a self contained control circuitry including a reservoir for a hydraulic fluid; sensing a drop below a pre-established level of pressure in a flowline distal to the surface safety valve and a drop below a pre-established level of pressure in a portion of a hydraulic circuit fluidly connected to a subsurface safety valve proximal to the subsurface safety valve, and responsive to sensing a drop of the pressure in either the flowline or the circuitry proximal to the subsurface valve: first draining fluid to the reservoir from a portion of the circuitry means hydraulically maintaining the surface safety valve open, then after a first time delay sufficient for closure of the surface safety valve, secondly draining fluid to the reservoir from a portion of the circuitry means hydraulically maintaining the subsurface safety valve open, and then after a second time delay sufficient for closure of the subsurface safety valve, thirdly isolating the subsurface safety valve at least from the portion of the circuitry means proximal to a subsurface safety valve.

19 Claims, 3 Drawing Sheets

SAFETY VALVE CLOSURE SYSTEM

FIELD OF THE INVENTION

This invention relates to systems for automatic closure of safety valves controlling the flow of fluids, particularly petroleum fluids from a producing well or fluid storage facility.

BACKGROUND OF THE INVENTION

Gate valves are generally comprised of a valve body having a central axis aligned with inlet and outlet passages, and a space between the inlet and outlet passages in which a slide, or gate, may be moved perpendicular to the central axis to open and close the valve. In the closed position, the gate surfaces typically seal against sealing rings which surround the fluid passage through the valve body. Gate valves have been used to control the flow of a great variety of fluids. Often the fluid to be controlled by the gate valve is under pressure. In the petroleum industry, gate valves are used along piping at various locations, and in particular are used in piping referred to in the petroleum industry as a christmas tree, which surmounts a wellhead and is used to control flowline distribution of production fluids from a well for a producing zone or for a storage reservoir.

Actuators to open and close the gate valves may employ manual operators, diaphragm-type operators, and hydraulic operators. The actuator typically includes a bonnet assembly, which interconnects the operator body and the gate valve body, and a bonnet stem which is movable with the gate via the operator.

Surface safety systems are used to control the actuator operator to close the gate valve in a fail-close operation and assure that the source of the fluids (the well or storage reservoir) is isolated from a flowline either if a flowline ruptures or otherwise experiences a loss in pressure (low pressure shutoff), or if the flowline experiences a higher pressure than the flowline is rated to handle (high pressure shutoff). The gate valve in such a system may be called a surface safety valve. A second safety valve may be located in the well production tubing several hundred feet below the ground surface, for instance, about 600 feet below the wellhead. Subsurface safety valves usually are installed for offshore wells, but sabotage destruction of surface safety systems has raised interest in use of subsurface valves for onshore application. The subsurface safety valve typically is a flapper or ball type valve which may be carried in a tubing connection or may be installable and set in place by wireline.

In a type of safety valve system, fluids at well pressure from the well under production are employed in hydraulic circuits to operate the actuator to open the surface and subsurface safety valves if pressures are within predetermined limits. These production fluids are also fed to high and low pressure pilots which control shut down of the system. When a low or high pressure condition exists, the respective pilot will trip, venting line pressure to the atmosphere and causing a check valve to block supply of line pressure to the actuator. The actuator then vents off pressure to the atmosphere through the pilot exhaust to close the valve. This position is maintained until the check valve is manually reset after the cause of the out-of-limits pressure experience is determined and corrected.

A problem with this prior approach is that the venting of petroleum gases and /or fluids into the atmospheric in this typical system is environmentally unsatisfactory, and can be dangerous and potentially lethal where the produced fluid contains hydrogen sulfide or carbon monoxide, especially if an oilfield worker is adjacent the wellhead when these poisonous gases at well pressures are automatically vented.

In high pressure wells, fluids pass through the open subsurface safety valve seals at high rates frictionally creating high temperatures that are destructive to seal life. A problem with the safety valve systems of the prior art, especially in high pressure wells, grows out of deteriorating seals in the subsurface safety valve. When the seals of the subsurface safety valves deteriorate, well pressure can leak past the seals of the closed subsurface safety valves into the reservoir, which may be objectionable to the well operator, and in any case, reduces the control line pressure above the closed valve and can allow the subsurface valve to re-open. This then allows production fluids to enter and flow through the valve control system lines. If those lines vent to the atmosphere, then the production fluids can escape from the well into the environment. The entry and passage of the well fluids through the safety control lines may also damage the surface safety system.

Damage to the subsurface valve requires removal of the valve apparatus from the subsurface location to a surface location where it can be repaired. In a tubing carried subsurface safety valve, this means a removal of tubing, at great expense and loss of revenues from well downtime. For a wireline set subsurface safety valve, retrieval is less onerous, but still requires a wireline rig to pull the valve apparatus, still at unwelcomed expense and well downtime.

It is an object of this invention to provide a completely self contained hydraulically operated surface safety valve actuator system which avoids contamination of the environment and eliminates the risk of harm to oil field workers from sudden release of hydrogen sulfide and/or other poisonous gases at the wellhead.

It is an object of this invention to provide a completely self contained hydraulically operated surface safety valve actuator system which does not make use of production line pressure to operate the actuator and which does not vent production fluids into the atmosphere.

It is a further object of this invention to provide a system for closing both surface and subsurface safety valves in a manner that prevents escape of production fluids to the atmosphere and environment, and which also eliminates injection of line control fluids into the reservoir from which the well is being produced.

These and other objects, benefits and advantages of the system of this invention will be apparent from the following description of the invention.

SUMMARY OF THE INVENTION

In accordance with this invention there is provided method and apparatus for controlling a surface safety valve and a subsurface safety valve in a producing hydrocarbons well. Briefly, the apparatus operates a method which involves (i) providing a self contained control circuitry including a reservoir for a hydraulic fluid; (ii) sensing a drop below a pre-established level of pressure in a flowline distal to the surface safety valve and a drop below a pre-established level of pressure in a portion of a hydraulic circuit fluidly connected to a subsurface safety valve proximal to the subsurface safety valve, and (iii) responsive to sensing a drop of the pressure in either the flowline or the circuitry proximal to the subsurface valve, first draining fluid to the reservoir from a portion of the circuitry means hydraulically maintaining the surface safety valve open, then after a first time delay sufficient for closure of the surface safety valve, secondly draining fluid to the reservoir from a portion of the circuitry means hydraulically maintaining the subsurface safety valve open, and then after a second time delay sufficient for closure of the subsurface safety valve, thirdly isolating the subsurface safety valve at least from the portion of the the circuitry means proximal to a subsurface safety valve.

The apparatus of this invention may be more particularly described as self contained apparatus for control of a plurality of safety valves, comprising: (i) a hydraulic fluid reservoir; (ii) a fluid collection circuit for the reservoir; a pump for pumping hydraulic fluid from the reservoir; (iii) first and second pilot valves each including a sense port, an inlet port and first and second outlet ports and valve means for fluidly connecting, in a pilot valve first position, both of the outlet ports while blocking the inlet port, or alternatively, in a pilot valve second position, for fluidly connecting the inlet port and the first outlet port while blocking the second outlet port, the second outlet ports of the first and second pilot valves being connected to the fluid collection circuit; (iv) a pilot relay valve including a sense port, an inlet port and first and second outlet ports and valve means for fluidly connecting in a first relay valve position both of the outlet ports while blocking the inlet port, or alternatively for fluidly connecting in a second relay valve position the inlet port and the first outlet port while blocking the second outlet port, the second outlet port of the pilot relay valve being connected to the fluid collection circuit; (v) a first fluid circuit for fluidly communicating the pump with the inlet ports of the first pilot valve and the first pilot relay valve at a first hydraulic pressure; (vi) a second fluid circuit for fluidly communicating hydraulic pressure from the pump sufficient to open a first safety valve in a first flowline and including a first dump valve for dumping hydraulic fluid from the second fluid circuit into the fluid collection circuit upon actuation of the first dump valve; (vii) a third fluid circuit line in fluid communication with the sense port of the first pilot valve, for fluid connection to the first flowline distal to where the first flowline is valved by the first safety valve; (viii) a fourth fluid circuit for fluidly communicating high pressure from the pump sufficient to open a second safety valve in a second flowline and including both a second dump valve for dumping hydraulic fluid from the fourth fluid circuit into the fluid collection circuit upon actuation of the second dump valve, and also a normally open first isolation valve for isolating the fourth fluid circuit from the second flowline proximal of the first isolation valve; (ix) a fifth fluid circuit line in fluid communication with the sense port of the second pilot valve, for fluid connection to the fourth flowline proximal to where the second flowline is valved by the second safety valve; (x) a sixth fluid circuit fluidly connected to the first outlet port of the pilot relay valve and in fluid communication with the first dump valve for actuating the first dump valve to dump hydraulic fluid from the second fluid circuit into the fluid collection circuit when fluid pressure in the sixth fluid circuit applied to the first dump valve drops below a pre-established level; (xi) a seventh fluid circuit in fluid communication with the first outlet port of the pilot relay valve and with the second dump valve for dumping hydraulic fluid from the fourth fluid circuit into the fluid collection circuit if fluid pressure in the seventh fluid circuit applied to the second dump valve drops below a pre-established level; and (viii) an eighth fluid circuit in fluid communication with the first outlet port of the pilot relay valve and the isolation valve, the first isolation valve being responsive to a drop in pressure in the eighth fluid circuit below a preestablished level and to close and isolate the fourth fluid circuit distally of the first isolation valve.

DETAILED DESCRIPTION OF THE INVENTION

Figure 1:
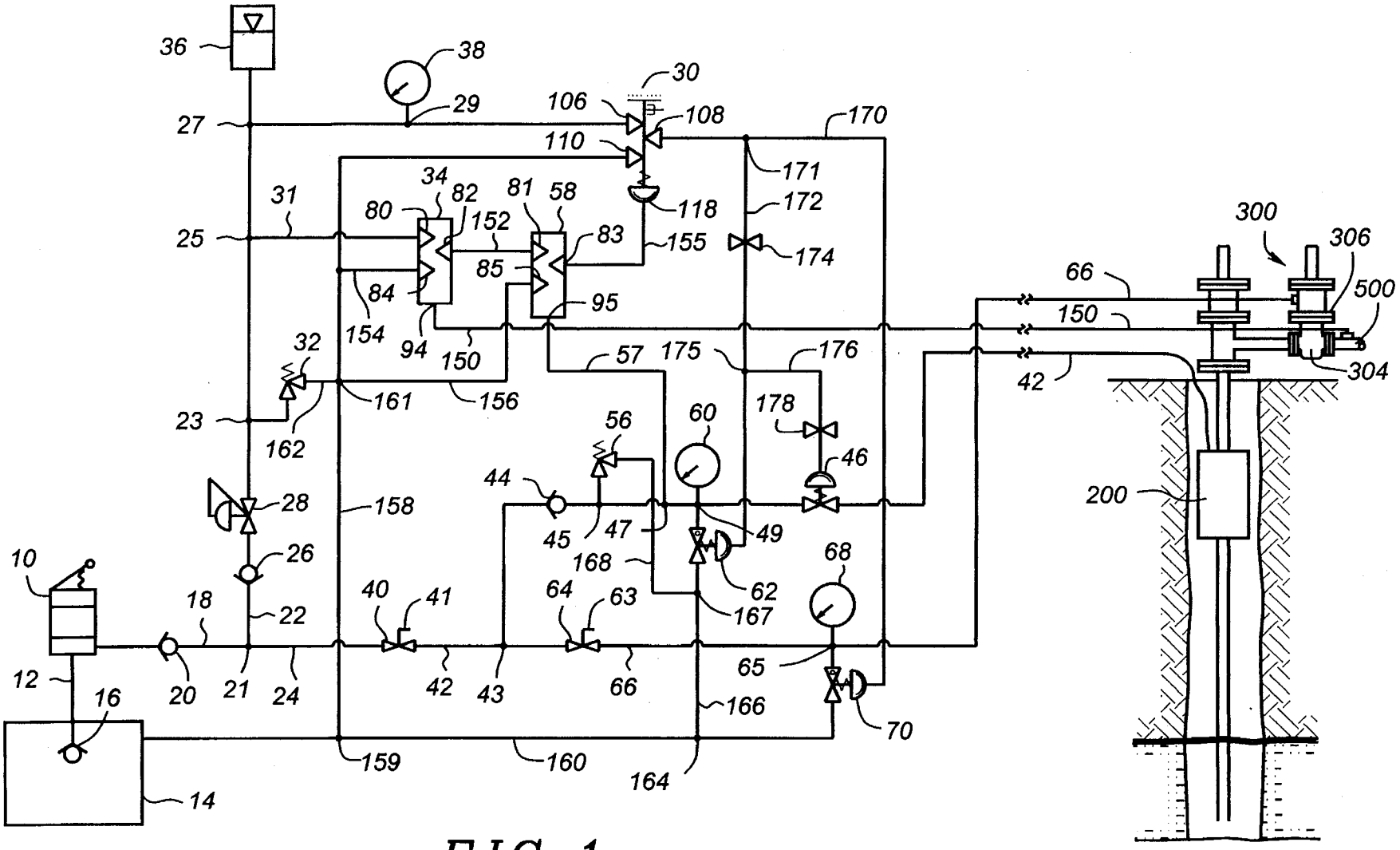
FIG. 1 is a piping schematic for the surface and subsurface safety valve system of this invention.

Referring to FIG. 1, a manual hand pump 10 is connected by intake line 12 to a reservoir 14 through a one-way check valve 16 which permits flow from reservoir 14 to hand pump 10. Pump 10 expels to line 18 through one-way check valve 20. Line 18 bifurcates at joint 21 into lines 22 and 24. Line 22 comprises a low pressure circuit and passes through one-way low pressure check valve 26, low pressure hydraulic regulator 28, and joints 23, 25, 27 and 29 to terminate at pilot relay valve 30. Connected to low pressure line 22 at joint 23 is low pressure relief valve 32. Connected to low pressure line 22 at joint 25 is inlet line 31 to flowline low pressure sensor pilot 34. Connected to low pressure line 22 at joint 27 is bladder accumulator 36. Connected to low pressure line 22 at joint 29 is low pressure gauge 38. Hydraulic regulator 28 suitably has a 0–200 psig outlet, a 5,000 psig working pressure and is set at 75 psig. Pilot relay valve 30 is more particularly described below in connection with FIG. 2, and suitably has a valve body working pressure of 250 psig and a pilot cap working pressure of 125 psig. Relief valve 32 suitably has a 50–150 psig range, and is suitably set at 95 psig. Pressure pilot 34 suitably has a 500–5,000 psig range, and is further described below in connection with FIG. 2. Bladder accumulator 36 suitably has a capacity of about 30 cubic inches and has a 2000 psig working pressure. Pressure gauge 38 suitably has a range of 0–160 psig, and is of the panel mount type for mounting on a control panel, as illustrated in FIG. 3 discussed in detail later.

Line 24 leads to two self contained high pressure circuits. One circuit is for control of a subsurface safety valve 200, and commences with isolation ball valve 40 fitted with handle 41. High pressure line 42 passes through joint 43, one-way high pressure check valve 44, joints 45, 47 and 49, and subsurface safety valve line isolation hydraulic valve 46, to terminate at a subsurface safety valve 200. Subsurface safety valve 200 typically is located in a tubing retrievable safety valve housing located in a well bore, for example about 600 feet below ground surface, and connected to tubing receiving the flow of a producing oil or gas well. Subsurface safety valve 200 typically is a valve of a flapper or ball valve design familiar to the oil tool industry, which normally is closed by pressure from fluids from producing zones of the well, which can be about 3000 psig, for example, for some wells. High pressure is delivered to subsurface safety valve 200 by line 42 to exceed the production tubing well pressure sufficiently to open subsurface safety valve 200 without violence which would damage the valve.

Connected to high pressure line 42 at joint 45 is high pressure relief valve 56. Connected to high pressure line 42 at joint 47 is a feed line 57 to subsurface safety valve low pressure sensor pilot valve 58. Connected to high pressure line 42 at joint 49 is pressure gauge 60 and subsurface safety valve line dump valve 62. Ball valve 40 suitably has a 6000 psig working pressure. Isolation valve 46 suitably is a two-way normally open ("N.O.") hydraulic pilot valve. Relief valve 56 suitably has a 3000–4000 psig range, and is set at 3500 psig. Pressure pilot 58 suitably has a 1,900–5,000 psig range, and is further described below in connection with FIG. 2. Pressure gauge 60 suitably has a range of 0–6000 psig, and is of the panel mount type for mounting on a control panel, as illustrated in FIG. 3 discussed in detail later. Dump valve 62 suitably is a two-way N.O. hydraulic pilot valve.

Figure 4:
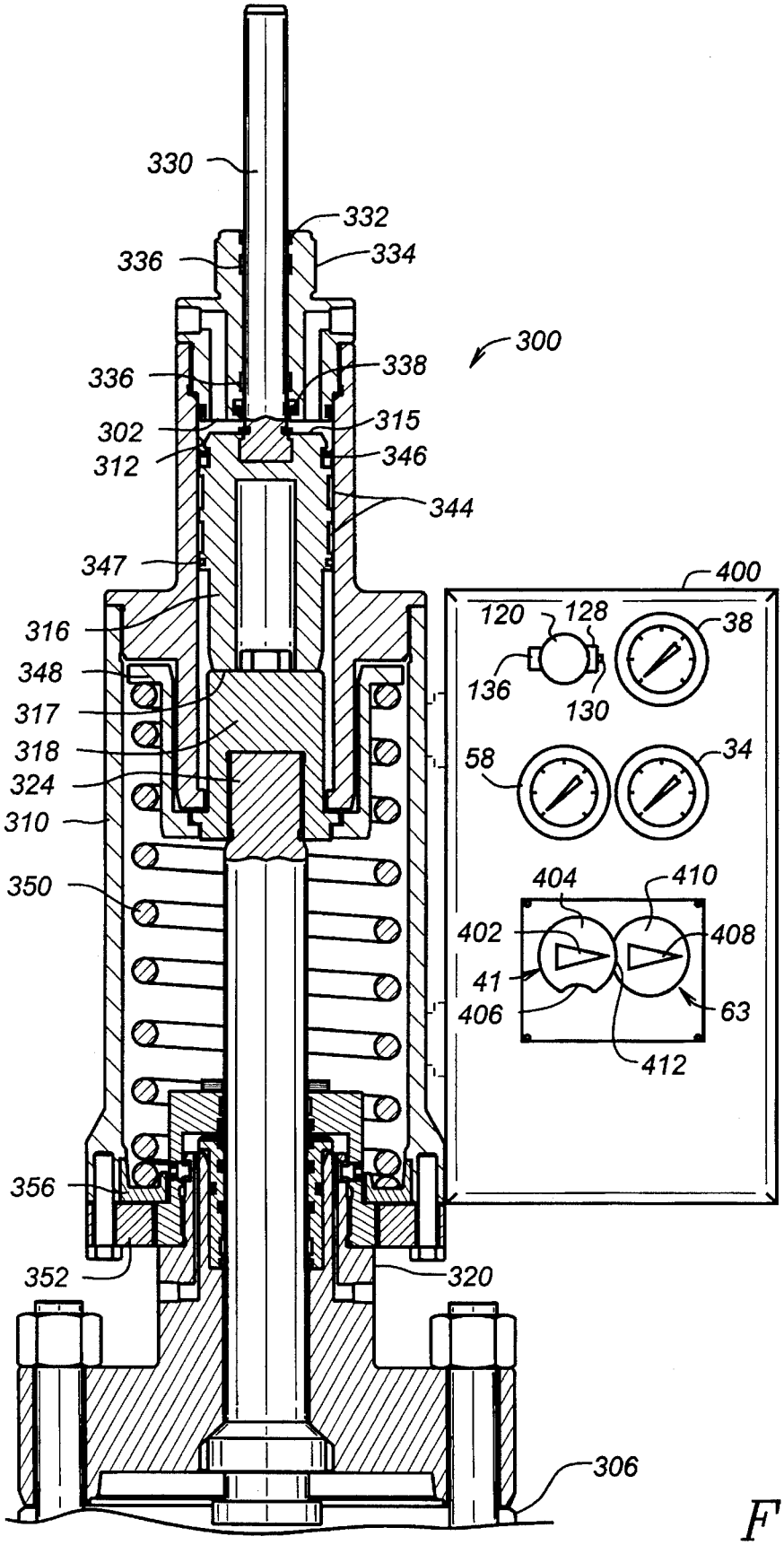
FIG. 4 is a frontal cross section of a hydraulic actuator valve and an associated front elevational view of a safety valve closure system instrument panel in accordance with this invention.

Line 42 also leads to a second high pressure circuit for control of a surface safety valve. This second high pressure circuit is gated by a surface safety valve line isolation ball valve 64 fitted with handle 63. Line 66 leaves valve 64 and passes through joint 65 to terminate at a fluid entry port 302 of surface safety valve hydraulic actuator 300, more particularly illustrated in FIG. 4, which is discussed in detail later. Connected to line 66 at joint 65 is surface safety valve line pressure gauge 68 and surface safety valve line dump valve 70. Suitably, surface safety valve line isolation ball valve 64 has a 6000 working pressure capability. Surface safety valve line pressure gauge 68 suitably has a range of 0–6000 psig, and is of the panel mount type for mounting on a control panel, as illustrated in FIG. 4 discussed in detail later. Surface safety valve line dump valve 70 suitably is a 2-way N.O. hydraulic pilot valve.

Figure 2:
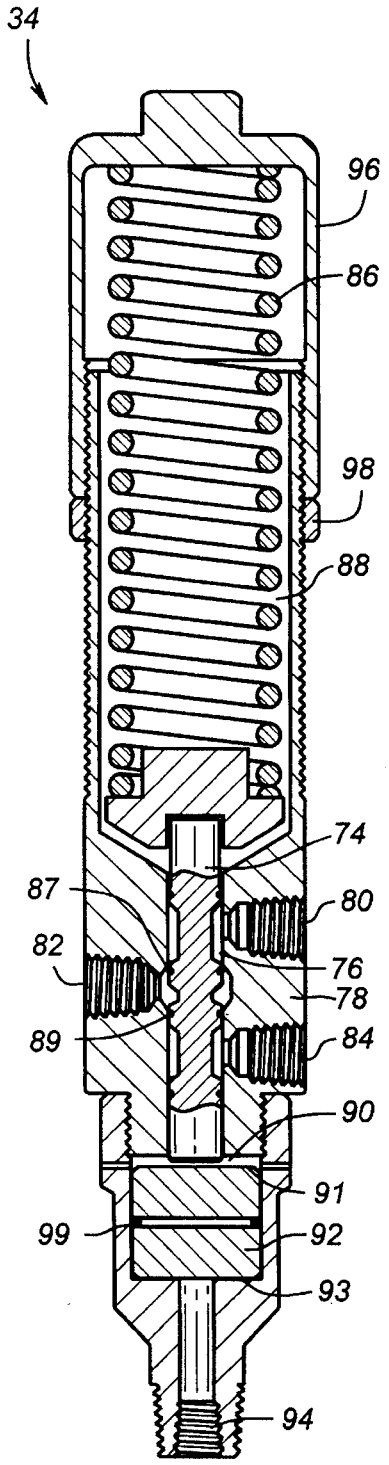
FIG. 2 is a schematic representation of pilot valve used in the piping schematic of FIG. 1.
Figure 3:
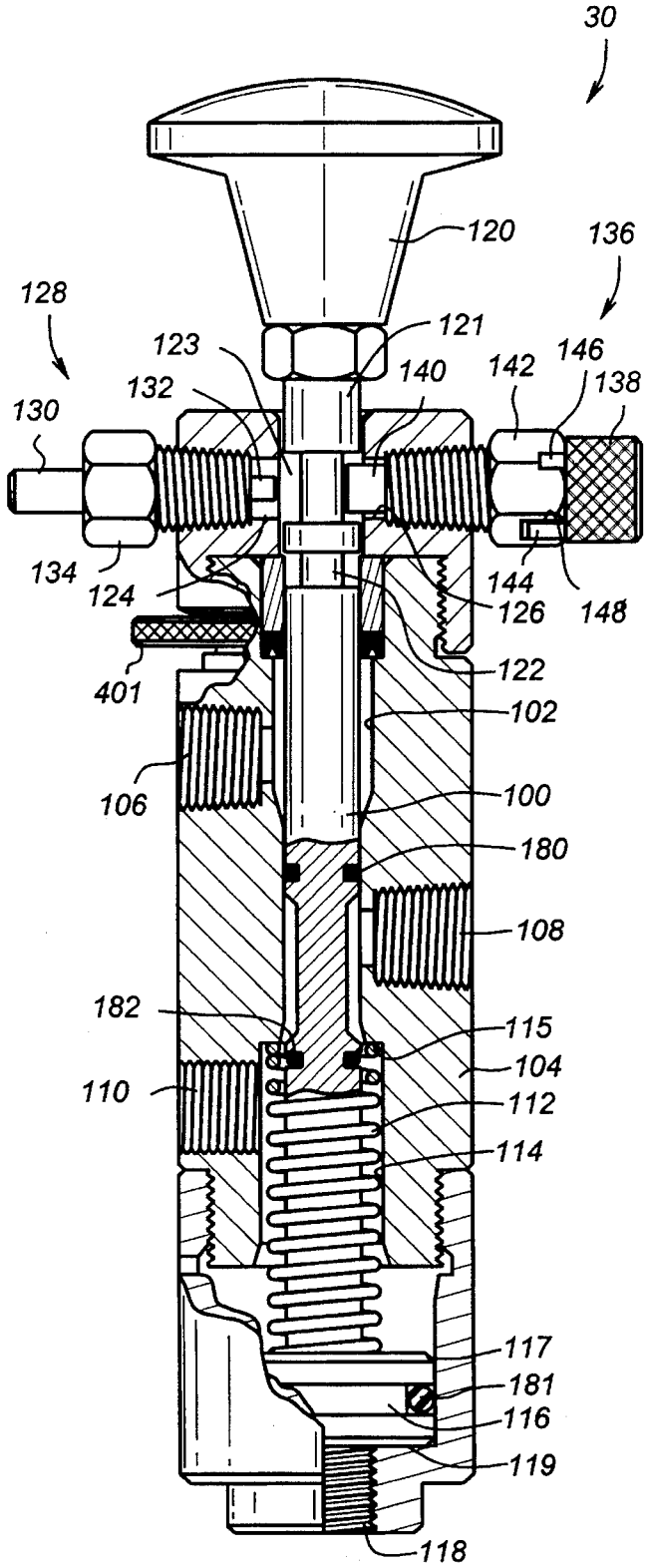
FIG. 3 is a schematic representation of pilot relay valve used in the piping schematic of FIG. 1.

Referring to FIGS. 1 and 2, flowline low pressure sensor pilot valve 34 is a spooltype, normally closed block and bleed three way valve. This kind of valve has a spool valve 74 sealingly slideable (seals 87,89) within a longitudinally bore 76 in a valve body 78. Spool valve 74 is slideable between alternate positions for controlling flow of a first fluid between lateral ports 80, 82 and 84 connecting into bore 76. Spool valve 74 is urged toward a first position under the force of a spring 86 arranged within a first chamber 88 located at one end of valve body bore 76. In this first position, outlet port 82 is fluidly connected to vent port 84 and inlet port 80 is blocked from both outlet port 82 and vent port 84. Within a second chamber 90 at the other end of valve body bore 76, a piston 92 is sealingly reciprocable (seal 99). The piston contacts spool valve 74 at an inner side 91 of the piston. Piston chamber 90 admits a second fluid through control pressure port 94 which contacts the outer side 93 of piston 92. This fluid, acting on piston 92 which acts on spool valve 74, urges spool valve 74 toward a second position against the resisting force of spring 86. In this second position, inlet port 80 is fluidly connected to outlet port 82, and vent port 84 is blocked from both inlet port 80 and outlet port 82. Spring 86 is selected and/or pre-tensioned, by adjustment of a spring cap 96 in cooperation with the position of locknut 98 acting on valve body 78, so that the chamber pressure on the outer side 93 of piston 92 from fluid under a pre-established line pressure fed by pressure port 94 will overcome the spring force and position spool valve 74 at the second position.

Subsurface safety valve pilot valve 58 is identical to pilot valve 34. Referring to FIG. 1, the comparable ports herein described for valve 58 are inlet port 81, outlet port 83, vent port 85 and control pressure port 95. The comparable reference numbers for the spool valve is 75 and for the piston is 97.

Referring now to FIGS. 1 and 3, pilot relay valve 30 is a normally closed block and bleed three way valve, provided with lock closed and lock open pins. A spool valve 100 is sealingly slideable (seals 180,182) longitudinally within a bore 102 in a valve body 104 between alternate positions for controlling flow of a first fluid between lateral ports 106, 108 and 110 connecting into bore 102. Spool valve 100 is urged toward a first position by force given by a spring 112 arranged in compression around one end of spool valve 100 within a chamber 114 at one end of valve body bore 102 between an inner side 117 of a piston 116 and a shoulder 115 formed in the valve body bore wall. Piston 116 contacts spool valve 100 at an inner side 117 of piston 116. In this first position, outlet port 108 is fluidly connected to vent port 110 and inlet port 106 is blocked from both outlet port 108 and vent port 110. Piston 116 is sealingly reciprocable (seal 181) within chamber 114 at the same end of valve body bore 102 containing spring 112. Below an outer side 119 of piston 116, chamber 114 admits a second fluid through a control pressure port 118 to contact the outer side 119. The force of the second fluid under pressure from the line feeding port 118 acting on the outer side of piston 116 urges piston 116 and thereby spool valve 100 toward a second position in which spool valve 100 acts to fluidly connect inlet port 106 to outlet port 108, and block vent port 110 from both inlet port 106 and outlet port 108. Spring 112 is selected so that the chamber pressure on the outside of piston 116 from fluid under a pre-established line pressure fed by pressure port 118 will overcome the force of spring 112 and position spool valve 74 at the second position.

At the other end of valve body bore 102, spool valve 100 connects to a palm knob 120 above an outside groove 121 and in inside groove 122 of spool valve 100. Transversely disposed to bore 102 are cross bore segments 124 and 126. Segment 124 threadedly receives a lock open assembly 128 comprising a sleeve 130 received in a bolt 134 threading into segment 124 and surrounding a spring loaded lock open pin 132. Segment 126 threadedly receives a lock closed assembly 136 comprising a knurled cap 138 for an axial lock closed pin 140 which reciprocates and rotates in a keeper bolt 142 threaded into cross bore segment 126. Assembly 136 further includes a lateral latch pin 144 affixed to the side of cap 138, and a shallow slot 146 and deep slot 148 longitudinally provided in bolt 142 for receiving latch pin 144.

Referring to FIG. 1, flowline low pressure sensor pilot valve 34 receives line 150 from flowline 500 at control pressure port 94, accepts line 31 from low pressure line 22 at inlet port 80, connects through outlet port 82 to line 152, and connects through vent port 84 to reservoir return connector line 154. Line 152 feeds to inlet port 81 of sensor pilot valve 58, which also receives subsurface safety valve pressure line 57 at pressure port 95, connects through outlet port 83 by line 155 to pressure port 118 of pilot relay valve 30, and vents through vent port 85 to reservoir return connector line 156.

Receiving reservoir return connector lines 154 and 156 is reservoir return trunk line 158, which at one end is connected to vent port 110 of pilot relay valve 30 and at the other end, by joint 159, is connected to reservoir return mainline 160. Connected to reservoir return trunk line 158 by joint 161 is line 162 to low pressure system relief valve 32. Reservoir return mainline 160 connects at one end to the reservoir return side of surface safety dump valve 70, and at the other end connects into hydraulic fluid reservoir 14. Received into reservoir return mainline 160 at joint 164 is a reservoir return line 166 for subsurface safety valve hydraulic fluid dump valve 62. Connected to line 166 at joint 167 is a reservoir return line 168 for high pressure relief valve 56.

Pilot relay valve outlet port 108 is connected to distal low pressure mainline 170, which terminates at the pilot cap side of hydraulic dump valve 70. Mainline 170 connects by joint 171 to distal low pressure trunk line 172, which passes across flow control valve 174 to connect to the pilot cap side of subsurface safety valve hydraulic fluid dump valve 62. Connected by joint 175 to distal low pressure trunk line 172 is a distal low pressure connector line 176 to subsurface safety valve line isolation valve 46. Line 176 is controlled by flow control valve 178.

Referring to FIG. 4, a safety control panel 400 is illustrated, attached to a hydraulic actuation surface safety valve apparatus 300. Pilot relay valve 30 is received in a panel opening and secured horizontally transverse to panel 400 by means of panel nut 401, so that palm knob 120, lock open assembly 128 and lock closed assembly 136 are above the surface of the panel. Also mounted in panel 400 are low pressure control pressure gauge 38, surface safety valve control pressure gauge 34, and subsurface safety valve control pressure gauge 58.

In addition, the handle 41 for subsurface safety valve line isolation valve 40 and the handle 63 for surface safety valve line isolation valve 64 are mounted above the vertical plane of panel 400. Handles 41 and 63 are depicted in closed position. Defining the closed position as 0 degrees, the open position of handles 41 and 63 is 90 degrees counterclockwise.

Handle 41 includes a raised arrow portion 402 for grasping to turn the handle, and a circular plate portion 404 below the level of arrow portion 402. Circular plate portion 404 is dished in a portion 406 of its periphery. Handle 63 also includes a raised arrow portion 408 for grasping to turn the handle, and a circular plate portion 410 below the level of arrow portion 408. Circular plate portion 410 is also dished in a portion 412 of its periphery. The diameters of plates 404 and 410 are equal, and the radii of the arcs of dished portions 406 and 412 are identical. The distance separating the centers of plates 404 and 410 is equal to the diameters of plates 404 and 410, resulting in an overlap of the circular plates except at dished portions 406 and 412. Defining the tip of arrow portions 402 and 408 as pointing respectively to zero degrees of the circular plates 404 and 410, dished portion 406 of plate 404 has a radius parallel and coincidental to the clockwise 90 degree radius of plate 404, and dished portion 412 of plate 410 has a radius parallel and coincidental to the clockwise 180 degree radius of plate 410. Accordingly, valve handle 41 of subsurface safety valve line isolation valve 40 can be turned only when valve handle 63 of surface safety valve line isolation valve 64 is in the closed position (as shown), and valve handle 63 of surface safety valve line isolation valve 64 can be turned only when valve handle 41 of subsurface safety valve line isolation valve 40 is in the open position (which is 90 degrees counterclockwise for the closed position shown).

If the surface valve were opened first and pressure were allowed to drop above the subsurface valve before it was opened, the differential pressure above and below the subsurface valve would be substantially negative, and in a high pressure well, allowing the subsurface valve to then open would cause it to open with great violence, which would risk damaging it. The "siamesed" arrangement of handles 41 and 63 assures that subsurface valve 200 is opened before flow is allowed from the well bore. This minimizes risk of damaging subsurface safety valve 200 upon opening it. Similarly, the arrangement assures that the surface valve is closed before flow from the subsurface safety valve is stopped by closure of the subsurface safety valve, also minimizing risk of damaging the subsurface safety valve. As mentioned above, minimizing damage to the subsurface valve is important, because removal of the subsurface safety valve for repair requires a rig to retrieve the valve, at substantial expense and loss of well on-line time, compared to the relative ease with which repairs can be made to the surface safety valve.

Also illustrated in FIG. 4 is surface safety valve hydraulic actuator 300. It comprises a valve operator for moving a gate valve 304 between open and closed valve positions within a gate valve body 306, and includes longitudinal pressure chamber 312 having a hydraulic fluid entry port 302 at one end thereof, a piston 316 reciprocable in chamber 312 moveable in response to hydraulic fluid introduced into said chamber 312 through fluid entry port 314 to impress a fluid side 315 of piston 316. An operator member or down-stop 318 is engageable by piston 316 on an engagement side 317 thereof opposite fluid side 315 and is moveable responsive to movement of piston 316. A bonnet housing 320 is securable to operator housing 310 and valve body 306 and has a bonnet housing bore 322 therethrough. A bonnet stem 324 is axially moveable in bonnet housing bore 322 and securable to gate valve 304 for moving gate valve 304 to the open and closed gate valve positions. The bonnet stem 324 is affixed to and axially moveable in response to movement of operator member 318 with respect to gate valve body 306. Hydraulic pressure moves piston 316 axially downwardly to move downstop 318 into engagement with stem spacers 342 on bonnet housing 320. Top shaft 330 is kept clean via rod wiper 332 disposed within removable top plug 334. Dual wear bearings 336, preferably formed of molygard, are used to support top shaft 330. Top plug 334 also includes a Polypak seal 338, preferably formed of Nitroxile. Piston 316 floats on preferably non-metallic wear bearings 344 and is further sealed with seals 346, 347. Upper spring retainer 348 applies force from coil 350 to move downstop 318 upwardly. Base plate ring 352 is bolted to housing 320 and provides support for lower spring retainer 356.

The system for operation of surface safety valve hydraulic actuator 300 (and for subsurface safety valve hydraulic actuator 200) is self contained, by which is meant that there is no dependence on external pneumatic, hydraulic, mechanical or electrical sources for safety closure of the oil or gas well if there is a rupture of the production flowline downstream from the surface valve or if there is a loss of well pressure at the subsurface safety valve. The safety closure system first closes the surface safety valve, then the subsurface safety valve, and then isolates the safety closure system and instrumentation from subsurface safety valve line pressures in the event of seal failure of the subsurface safety valve, thereby avoiding a source of potential damage to the safety closure system. Because all fluid is returned to a reservoir when the surface and subsurface valves are closed, there is no pollution of the environment and any hydrogen sulfide and carbon monoxide gases from the well are contained in the well.

To bring the safety closure system into operation, the surface safety valve 304 and subsurface safety valve 200 are first closed. Referring to FIGS. 1–4, surface safety valve line handle 63 on instrument panel 400 is turned clockwise 90 degrees to the closed position, to close surface safety valve isolation ball valve 64. This allows subsurface safety valve line handle 41 to be turned clockwise 90 degrees to the closed position, to close subsurface safety valve isolation ball valve 40. Then pilot relay valve 30 is prepared to receive and transfer low pressure hydraulic fluid. Lock close pin 140 of pilot relay valve 30 is pulled out of groove 123 of spool valve 100, which also lifts latch pin 144 from deep slot 148 of bolt 142. Lock close pin 140 is then rotated to place latch pin 144 in shallow slot 146. Next, knob 120 is grasped and pulled, pulling spool valve 100 away from port 118 toward crossbores 124, 126. This compresses spring 112 between inner side 117 of piston 116 and shoulder 115 of valve body 104, and places groove 122 of spool valve 100 opposite cross bore segment 124. Lock open pin 132 is then depressed into groove 122 and knob 120 is released. This causes spring 112 to pull the inside shoulder of the portion of spool 100 between outside groove 121 and inside groove 122, and thereby press against the depressed pin 132, preventing it from being retracted into sleeve 130 under its own spring loading. In this spool valve position, spool valve 100 is in the "second position" referred to above when describing pilot relay valve 30, i.e., spool valve 100 fluidly connects inlet port 106 to outlet port 108, and blocks vent port 110 from both inlet port 106 and outlet port 108; accordingly, supply pressure from line 22 is allowed to flow through inlet port 106 to outlet port 108 of pilot valve relay 30.

Manual hydraulic pump 10 is then stroked to withdraw hydraulic fluid from reservoir 14 through check valve 16 and line 12 into low pressure line 22 and across check valves 20 and 26, low pressure regulator 28 and low pressure relief valve 32 into each of (i) inlet port 106 of locked open pilot valve relay 30 and then out through outlet port 108 and thence through low pressure lines 170 172 and 176 to dump valves 70 and 62 and isolation valve 46, respectively, (ii) low pressure connection line 31 to inlet port 80 of flowline low pressure sensor pilot valve 34, and (iii) accumulator 36, until a preestablished pressure, suitably 75 psig is indicated on low pressure system pressure gauge 38.

Next the subsurface safety valve 200 is pressurized to open the subsurface safety valve. Siamesed subsurface safety valve line handle 41 is turned counterclockwise 90 degrees to the open position, to open subsurface safety valve isolation valve 40. Manual pump 10 is then stroked. Regulator 28 blocks further pressurization of line 22, and hydraulic fluid from reservoir 14 is moved by pump 10 into line 42 through subsurface safety valve isolation valve 40, check valve 44 and subsurface safety valve line isolation valve 46 to subsurface safety valve actuator 200. Hydraulic fluid is also pumped through connection line 57 to sense port 95 of subsurface safety valve line low pressure sensor pilot valve 58 and the connection line to the normally open port of subsurface safety valve line dump valve 62. Stroking is continued until a pre-established subsurface safety valve control pressure (set to be the same as well pressure on the bottomside of the subsurface safety valve, e.g. from about 1800 to about 4200 psig) is indicated on subsurface safety valve line pressure gauge 60. Line pressure supplied through connection line 57 to sense port 95 of subsurface safety valve line low pressure sensor pilot valve 58 pushes piston 97 in pilot valve 58 against spool valve 75 therein, moving spool valve 75 to the same "second position" described above for pilot valve 34, namely spool valve 75 fluidly connects inlet port 81 to outlet port 83 and blocks vent port 85 from both inlet port 81 and outlet port 83. This applies the low pressure from lines 22, 31, passed through ports 80, 82 of pilot valve 34, to 152, to pressurize port 118 of pilot relay valve 30, pushing relay piston 116 to the already locked open spool valve 100. This movement relieves the locked open tension from spring 112 pulling the upper side of groove 122 against the upper side of lock open pin 132, which allows spring loaded pin 132 to retract, thus providing an automatic release of lock open pin 132 when pilot relay valve 30 is pressurized. Thereafter, relay 30 will stay in the open position so long as pressure transmitted to sense port 95 through connection line 57 from line 42 for subsurface safety valve actuator 200 is present at a pre-established minimum at the outer side of piston 95 of pilot valve 58.

With the subsurface safety valve 200 open, the surface safety valve is ready to be opened. The open position of the subsurface safety valve line handle 41 permits siamesed surface safety line handle 63 to be rotated counterclockwise 90 degrees to the open position, to open surface safety valve line isolation valve 64. Manual pump 10 is stroked again, and hydraulic fluid from reservoir 14 is moved by pump 10 into line 42 through surface safety valve line isolation valve 64 to surface safety valve hydraulic actuator 300, where the fluid enters portal 302 and enters clearance chamber 312 at the top of actuator piston 316. Continued pumping of the hydraulic fluid drives piston 316 downwardly, in turn driving downwardly operator member 318, bonnet stem 324 and the gate (not shown) of gate valve 304, until the gate is in alignment with the central axis of flowline 500. Pressurized surface safety valve line 42 connects through line 65 to surface safety valve line dump valve 70. Flowline 500 is indicated opened when a pre-established surface safety valve pressure (set to be more than the well pressure on the subsurface safety valve, e.g. 3000 psig) is signaled on pressure gauge 68.

If there is a loss of pressure in flowline 500 measured downstream of gate valve 304 of hydraulic actuator 300, piston 92 in flowline low pressure sensor pilot valve 34 is no longer able to resist the extension force exerted by compressed spring 86 bearing against spool valve 74, and spool valve 74 is driven to its "first position" described above for pilot valve 34, that is, outlet port 82 is fluidly connected to vent port 84 and inlet port 80 is blocked from both outlet port 82 and vent port 84. In consequence, hydraulic fluid is bled off to line 154 for return by lines 158, 160 to reservoir 14. The fluid which is bled off drains interconnecting line 152, and through subsurface safety valve line low pressure sensor inlet port 81 and outlet port 83, pilot valve relay pressure line 155. This in turn causes piston 116 in pilot valve relay 30 to retract under the extension force exerted by compressed spring 112 bearing against the inner side 117 of piston 116. This retraction drives spool valve 100 to the "first position" described above for pilot relay valve 30, namely, where outlet port 108 is fluidly connected to vent port 110 and inlet port 106 is blocked. This bleeds hydraulic fluid from lines 170, 172 and 176 into reservoir return line 158 for return to reservoir 14.

The resultant drop in pressure in line 170 permits the spring in surface safety valve line dump valve 70 to open valve 70 and quickly drain fluid from surface safety valve line 66 to reservoir 14 through main return line 160. This rapid loss of pressure in surface safety valve line 66 allows the well pressure on the well side of gate valve 304 assisted by a spring of operator 318 of surface safety valve actuator 300 to drive piston 316 toward the top of chamber 312, moving the gate of gate valve 304 out of alignment with the central axis of flowline 500, shutting off flow in flowline 500 past gate member 305.

In line 172, flow restrictor valve 174 is sized to restrict the rate at which fluid pressure drops between restrictor valve 174 and subsurface safety valve line dump valve 62, delaying, suitably for 30 seconds, the pressure drop sufficient to allow the spring in subsurface safety valve line dump valve 62 to extend and open dump valve 62. This allows sufficient time for surface safety valve 304 to close before subsurface safety valve line fluid is dumped to reservoir 14, dropping pressure in line 42 and closing subsurface safety valve 200.

In line 176, drainage is first slowed by restrictor 174, and is further slowed by restrictor 178, suitably for an additional 15 seconds after pressure drops in line 172 at dump valve 62 sufficiently to actuate dump valve 62. This additional time allows subsurface safety valve 200 to close before subsurface safety valve line isolation valve 46 is actuated by drop in pressure in line 176.

On the other hand, if there is a loss in pressure keeping the subsurface valve open, first the surface safety valve is closed to shut off the flowline. A drop in pressure in line 57 by a pre-established amount trips pilot valve 58 to the first position, bleeding pressure from pilot relay 30 and causing dump valve 70 to line 66 for the hydraulic actuator 300 to open first, reducing pressure to hydraulic actuator chamber 312, retracting piston 316 and closing gate valve 304. Then the subsurface safety valve 200 is closed. The drop in pressure from pilot relay 30 triggers the time delayed pressure drop in line 172, causing dump valve 62 to open and drain fluid pressure in line 42, causing subsurface safety valve 200 to close. Lastly, the same drop in pressure from pilot relay 30 triggers the time delayed pressure drop in line 176, causing isolation valve 46 to close and close line 42 from subsurface valve 200, to protect the instrument system from pressure leakage across valve 200 should leakage occur.

After pilot relay valve 30 goes to the first position when tripped by low pressure signals either from flowline 500 or subsurface safety valve line 42, lock closed pin 140 is then rotated back to align latch pin 144 with deep slot 148, and lock closed pin is pushed into groove 123 with latch pin 144 advancing into deep slot 148. This prevents the pilot relay valve 30 from accidental resetting and re-establishing communication through inlet port 106 and outlet port 108.

From the foregoing description, it is seen that the safety valve control system of this invention is self contained, using its own closed loop supply of hydraulic fluid, providing an automatic monitoring of flow pressures at the subsurface safety valve and at the flowline past the surface safety valve. If one monitored line pressure drops, the valve controlling that line and another line is closed.

Having now described this invention in detail, this invention is not to be deemed limited to the specific embodiments detailed, but as defined by the claims appended hereto. In construing the claims, equivalent ways of accomplishing the same results by substantially the functions will be apparent to those skilled in the art now informed of this invention, and those equivalents within the spirit of this invention are intended within the scope of this invention.

What is claimed is:

1. Apparatus for controlling a surface safety valve and a subsurface safety valve in a producing hydrocarbons well, comprising self contained hydraulic circuitry means including (i) a hydraulic reservoir, (ii) hydraulic sensor means for sensing a drop below a pre-established level of pressure in a flowline distal to the surface safety valve and a drop below a pre-established level of pressure in a portion of the said circuitry means proximal to a subsurface safety valve, (iii) circuitry fluid draining and isolation means responsive to said sensor means sensing a drop of said pressure in either said flowline or said circuitry proximal to said subsurface valve, to first drain fluid to said reservoir from a portion of said circuitry means hydraulically maintaining said surface safety valve open, then after a first time delay sufficient for closure of said surface safety valve, to secondly drain fluid to said reservoir from a portion of said circuitry means hydraulically maintaining said subsurface safety valve open, then after a second time delay sufficient for closure of said subsurface safety valve, thirdly to isolate said subsurface safety valve at least from said portion of the said circuitry means proximal to a subsurface safety valve, and (iv) circuitry flow restrictor means for imposing said first and second time delays.

2. Self contained apparatus for control of a plurality of safety valves, comprising:

a hydraulic fluid reservoir;

a fluid collection circuit for said reservoir;

a pump for pumping hydraulic fluid from said reservoir;

first and second pilot valves each including a sense port, an inlet port and first and second outlet ports and valve means for fluidly connecting, in a pilot valve first position, both of said outlet ports while blocking said inlet port, or alternatively, in a pilot valve second position, for fluidly connecting said inlet port and said first outlet port while blocking said second outlet port, said second outlet ports of said first and second pilot valves being connected to said fluid collection circuit;

a pilot relay valve including a sense port, an inlet port and first and second outlet ports and valve means for fluidly connecting in a first relay valve position both of said outlet ports while blocking said inlet port, or alternatively for fluidly connecting in a second relay valve position said inlet port and said first outlet port while blocking said second outlet port, said second outlet port of said pilot relay valve being connected to said fluid collection circuit;

a first fluid circuit for fluidly communicating said pump with said inlet ports of said first pilot valve and said first pilot relay valve at a first hydraulic pressure;

a second fluid circuit for fluidly communicating hydraulic pressure from said pump sufficient to open a first safety valve in a first flowline and including a first dump valve for dumping hydraulic fluid from said second fluid circuit into said fluid collection circuit upon actuation of said first dump valve;

a third fluid circuit line in fluid communication with said sense port of said first pilot valve, for fluid connection to said first flowline distal to where said first flowline is valved by said first safety valve;

a fourth fluid circuit for fluidly communicating high pressure from said pump sufficient to open a second safety valve in a second flowline and including both a second dump valve for dumping hydraulic fluid from said fourth fluid circuit into said fluid collection circuit upon actuation of said second dump valve, and also a normally open first isolation valve for isolating said fourth fluid circuit from said second flowline proximal of said first isolation valve;

a fifth fluid circuit line in fluid communication with said sense port of said second pilot valve, for fluid connection to said second flowline proximal to where said second flowline is valved by said second safety valve;

a sixth fluid circuit fluidly connected to said first outlet port of said pilot relay valve and in fluid communication with said first dump valve for actuating said first dump valve to dump hydraulic fluid from said second fluid circuit into said fluid collection circuit when fluid pressure in said sixth fluid circuit applied to said first dump valve drops below a pre-established level;

a seventh fluid circuit in fluid communication with said first outlet port of said pilot relay valve and with said second dump valve for dumping hydraulic fluid from said fourth fluid circuit into said fluid collection circuit if fluid pressure in said seventh fluid circuit applied to said second dump valve drops below a pre-established level; and an eighth fluid circuit in fluid communication with said first outlet port of said pilot relay valve and said isolation valve, said first isolation valve being responsive to a drop in pressure in said eighth fluid circuit below a pre-established level and to close and isolate said fourth fluid circuit distally of said first isolation valve.

3. The apparatus of claim 2, in which said seventh fluid circuit further comprises a first flow restriction valve, between said first outlet port of said pilot relay valve and said second dump valve, for restricting flow in said seventh fluid circuit distal of said first flow restriction valve when pressure drops in said seventh fluid circuit proximate of said first flow restriction valve.

4. The apparatus of claim 2, in which said eighth fluid circuit further comprises a second flow restriction valve, between said first outlet port of said pilot relay valve and said isolation valve, for restricting flow in said eighth fluid circuit distal of said second flow restriction valve when pressure drops in said eighth fluid circuit proximate of said second flow restriction valve.

5. The apparatus of claim 3 in which said eighth fluid circuit communicates with said first outlet port of said pilot relay valve distally of said first flow restriction valve in said seventh fluid circuit.

6. The apparatus of claim 2 in which said fifth fluid circuit is in fluid communication with said sense port of said second pilot valve proximate said first isolation valve.

7. The apparatus of claim 2 in which said fourth fluid circuit includes a second isolation valve which in open state connects said fourth fluid circuit to fluid communication to said pump and a third isolation valve which in open state fluidly communicates said pump to said second fluid circuit.

8. The apparatus of claim 2 further including an accumulator in said first fluid circuit.

9. The apparatus of claim 2 further including a pressure regulator for regulating pressure in said first fluid circuit to said pre-established low pressure.

10. The apparatus of claim 9 further including a low pressure relief valve distal of said pressure regulator and connected to said fluid collection circuit.

11. The apparatus of claim 2 further including a low pressure relief valve in said fourth fluid circuit proximal of said second dump valve and distal to said second isolation valve and connected to said fluid collection circuit.

12. The apparatus of claim 2 in which said first safety valve is a surface safety valve and said second safety valve is a subsurface safety valve.

13. Self contained apparatus for control of a surface safety valve in a first flowline and a subsurface safety valve in a second flowline, comprising:

a hydraulic fluid reservoir;

a fluid collection circuit for said reservoir;

a pump for pumping hydraulic fluid from said reservoir;

first and second pilot valves each including a sense port, an inlet port and first and second outlet ports and valve means for fluidly connecting, in a pilot valve first position, both of said outlet ports while blocking said inlet port, or alternatively, in a pilot valve second position, for fluidly connecting said inlet port and said first outlet port while blocking said second outlet port, said second outlet ports of said first and second pilot valves being connected to said fluid collection circuit;

a pilot relay valve including a sense port, an inlet port and first and second outlet ports and valve means for fluidly connecting in a first relay valve position both of said outlet ports while blocking said inlet port, or alternatively for fluidly connecting in a second relay valve position said inlet port and said first outlet port while blocking said second outlet port, said second outlet port of said pilot relay valve being connected to said fluid collection circuit;

a first fluid circuit for fluidly communicating said pump with said inlet ports of said first pilot valve and said first pilot relay valve and including an accumulator and a pressure regulator for regulating pressure in said first fluid circuit to a pre-established low hydraulic pressure and a low pressure relief valve distal of said pressure regulator and connected to said fluid collection circuit;

a second fluid circuit for fluidly communicating hydraulic pressure from said pump sufficient to open a first safety valve in a first flowline and including a first dump valve for dumping hydraulic fluid from said second fluid circuit into said fluid collection circuit upon actuation of said first dump valve;

a third fluid circuit line in fluid communication with said sense port of said first pilot valve, for fluid connection to said first flowline distal to where said first flowline is valved by said first safety valve;

a fourth fluid circuit for fluidly communicating high pressure from said pump sufficient to open a second safety valve in a second flowline and including (i) a second dump valve for dumping hydraulic fluid from said fourth fluid circuit into said fluid collection circuit upon actuation of said second dump valve, (ii) a normally open first isolation valve for isolating said fourth fluid circuit from said second flowline proximal of said first isolation valve, (iii) a second isolation valve which in open state connects said fourth fluid circuit to fluid communication to said pump, (iii) a third isolation valve which in open state fluidly communicates said pump to said second fluid circuit, and (iv) a low pressure relief valve proximal of said second dump valve and distal to said second isolation valve and connected to said fluid collection circuit;

a fifth fluid circuit line in fluid communication with said sense port of said second pilot valve proximate said first isolation valve, for fluid connection to said fourth flowline proximal to where said second flowline is valved by said second safety valve;

a sixth fluid circuit fluidly connected to said first outlet port of said pilot relay valve and in fluid communication with said first dump valve for actuating said first dump valve to dump hydraulic fluid from said second fluid circuit into said fluid collection circuit when fluid pressure in said sixth fluid circuit applied to said first dump valve drops below a pre-established level;

a seventh fluid circuit in fluid communication with said first outlet port of said pilot relay valve and with said second dump valve for dumping hydraulic fluid from said fourth fluid circuit into said fluid collection circuit if fluid pressure in said seventh fluid circuit applied to said second dump valve drops below a pre-established level, said seventh fluid circuit including a first flow restriction valve, between said first outlet port of said pilot relay valve and said second dump valve, for restricting flow in said seventh fluid circuit distal of said first flow restriction valve when pressure drops in said seventh fluid circuit proximate of said first flow restriction valve; and an eighth fluid circuit in fluid communication with said first outlet port of said pilot relay valve distally of said first flow restriction valve in said seventh fluid circuit and with said isolation valve, said first isolation valve being responsive to a drop in pressure in said eighth fluid circuit below a pre-established level and to close and isolate said fourth fluid circuit distally of said first isolation valve, said eighth fluid circuit including a second flow restriction valve, between said first outlet port of said pilot relay valve and said isolation valve, for restricting flow in said eighth fluid circuit distal of said second flow restriction valve when pressure drops in said eighth fluid circuit proximate of said second flow restriction valve.

14. Apparatus for controlling (i) a valve actuator for moving a surface safety valve between open and closed valve positions within a valve body, said actuator including an operator housing defining a longitudinal pressure chamber therein and having a hydraulic fluid entry port at one end thereof and a piston reciprocable in said chamber moveable in response to hydraulic fluid introduced into said operator housing chamber through said fluid entry port to impress a fluid side of said piston, an operator moveable responsive to said piston movement to open and close said valve, (ii) a subsurface safety valve device to an open or closed position, said subsurface valve including means responsive to hydraulic fluid pressure to open or close the subsurface valve, comprising a reservoir for hydraulic fluid;

a pump connected to said reservoir;

a return line for returning hydraulic fluid to said reservoir;

a first isolation valve openable and closeable to pass or close passage of fluid pumpable from said reservoir;

a first hydraulic line connecting said first isolation valve to said fluid entry port of said pressure chamber of said actuator operator housing;

a first dump valve connected to said first hydraulic line and said return line and operable to open and discharge fluid from said first hydraulic line to said return if fluid pressure supplied to control said dump valve closed drops below a pre-established pressure level;

a first pilot valve which comprises a valve body having first and second ends and a longitudinal bore, three longitudinally spaced lateral ports to the bore, a spool having first and second ends and longitudinally reciprocable within the bore between a first position blocking a first of said ports and fluidly connecting a second and third of said ports and a second position blocking the third of said ports and fluidly connecting the first and second of said ports, a plurality of seal rings longitudinally spaced along said spool and sealably slideable within the bore for controlling flow of a first fluid between said ports in each of said first and second positions, said body having an enlarged chamber at one end of the bore, a coil spring arranged in said chamber, means for compressing the spring in said chamber including a cap for one end of said spring connectable to said body at said first end of said body and a retainer for the other end of said spring on one side and for said first end of said spool on an opposite side, thereby to apply force to said first end of said spool to urge the spool to said first position, a piston housing connectable to said body at said second end of the body, a piston sealingly reciprocable in said housing in contact with said second end of said spool on a spool side thereof, said housing having a port therein for admitting a second fluid to impress said piston on the side thereof opposite said spool side and urge said piston toward said spool thereby to move said spool to said second position;

a pilot relay valve which comprises a valve body having first and second ends and a longitudinal bore, three longitudinally spaced lateral ports to the bore, a spool having first and second ends and longitudinally reciprocable in the bore between a first position blocking a first of said ports and fluidly connecting a second and third of said ports and a second position blocking the third of said ports and fluidly connecting the first and second of said ports, a plurality of seal rings longitudinally spaced along said spool and sealably slideable within the bore for controlling flow of a first fluid between said ports in each of said first and second positions, said body having an enlarged chamber at a first end of the bore within said first end of the body, a spool coil spring arranged around a length of said spool in said chamber, a piston housing connectable to said first end of the body, a piston sealingly reciprocable in said housing in contact with said first end of said spool on a spool side thereof, said housing being connectable to said body to compress said spool spring between the spool side of the piston and the end of the chamber distal to the piston thereby to urge said spool to said first position, said housing having a port therein for admitting a second fluid to impress said piston on the side thereof opposite said spool side and urge said piston against said spool thereby to move said spool to said second position, a lock pin housing having first and second bores and connectable to said second end of the body with said first bore coaxial to said valve body bore, said second bore comprising first and second segments transverse to said first bore, lock open pin means arranged in said first segment including a pin slideable from said first segment into said first bore and a pin spring urging said pin in the direction away from said first bore for locking said spool in said second position when said pin is in positioned in said first bore, lock closed pin means arranged in said second segment including a pin slideable from said second segment into said first bore and a retainer about said lock closed pin for manually retaining said pin out of said first bore, said spool proximal said second end including at least one groove for capture of said lock pins, said second end of said spool terminating in a knob external to said second end of said body for manually pulling said spool into said second position against the resistance of said spool spring for locking said lock open pin in said spool groove;

a second hydraulic line for fluidly connecting said hydraulic pump to each of said first port of said pilot valve, said first port of said pilot relay valve, and said first isolation valve;

a pressure regulator interposed in said second hydraulic line between said pump and each of said first port of said pilot valve and said first port of said pilot relay valve to limit the pressure attainable by fluid pumpable thereto;

means including a third hydraulic line for fluidly communicating from said second port of said pilot valve to said piston housing port of said pilot relay valve;

a fourth hydraulic line in fluid communication with said second port of said pilot relay valve and connecting to said first dump valve to supply fluid pressure to control said dump valve in closed position; and a fifth hydraulic line connecting said piston housing port of said pilot valve to said flowline;

a sixth hydraulic line connecting said third port of said first pilot valve to said return line; and a seventh hydraulic line connecting said third port of said pilot relay valve to said return line;

a second pilot valve which comprises a valve body having first and second ends and a longitudinal bore, three longitudinally spaced lateral ports to the bore, a spool having first and second ends and longitudinally reciprocable within the bore between a first position blocking a first of said ports and fluidly connecting a second and third of said ports and a second position blocking the third of said ports and fluidly connecting the first and second of said ports, a plurality of seal rings longitudinally spaced along said spool and sealably slideable within the bore for controlling flow of a first fluid between said ports in each of said first and second positions, said body having an enlarged chamber at one end of the bore, a coil spring arranged in said chamber, means for compressing the spring in said chamber including a cap for one end of said spring connectable to said body at said first end of said body and a retainer for the other end of said spring on one side and for said first end of said spool on an opposite side, thereby to apply force to said first end of said spool to urge the spool to said first position, a piston housing connectable to said body at said second end of the body, a piston sealingly reciprocable in said housing in contact with said second end of said spool on a spool side thereof, said housing having a port therein for admitting a second fluid to impress said piston on the side thereof opposite said spool side and urge said piston toward said spool thereby to move said spool to said second position;

said second pilot valve being interposed in said third hydraulic line to receive fluid from said second port of said first pilot valve at said first port of the second pilot valve for fluidly communicating to said piston housing port of said pilot relay valve;

an eighth hydraulic line connecting said third port of said second pilot valve to said return line;

a second isolation valve, interposed in said second hydraulic line between said first isolation valve and said pump, and openable and closeable to pass or close passage of fluid pumpable from said reservoir;

a ninth hydraulic line connected to said second hydraulic line between said first and second isolation valves and connecting to said responsive means of said subsurface safety valve;

a second dump valve connected to said ninth hydraulic line and said return line and operable to open and discharge fluid from said ninth hydraulic line to said return line if fluid pressure supplied to control said second dump valve in closed position drops below a predetermined pressure level;

a tenth hydraulic line in fluid communication with said second port of said pilot relay valve and connecting to said second dump valve to supply fluid pressure to control said second dump valve in closed position;

a first flow restrictor interposed in said tenth hydraulic line between said second port of said pilot relay valve and said second dump valve to delay for a set time the time required for said fluid pressure supply to said second dump valve to reach said predetermined level if said spool in said pilot relay valve is moved to said first position after said tenth hydraulic line is pressurized with fluid pumped from said reservoir;

an eleventh hydraulic line connecting said piston housing port of said second pilot valve to said ninth hydraulic line;

a third isolation valve, interposed in said subsurface safety valve hydraulic line between said subsurface safety valve hydraulic line dump valve and said subsurface safety valve, openable and closeable to pass or close passage of fluid through said subsurface safety valve hydraulic line, operable open unless and closeable if fluid pressure supplied to control said third isolation valve open drops below a predetermined pressure level;

a twelfth hydraulic line in fluid communication with said second port of said pilot relay valve and connecting to said third isolation valve to supply fluid pressure to control said third isolation valve in open position;

a second flow restrictor interposed in said twelfth hydraulic line between said second port of said pilot relay valve and said third isolation valve to delay for a set time the time required for said fluid pressure supply to said third isolation valve to reach said predetermined level if said spool in said pilot relay valve is moved to said first position after said twelfth hydraulic line is pressurized with fluid pumped from said reservoir, said set time for said second flow restrictor exceeding said set time for said first flow restrictor.

15. A method of controlling a surface safety valve and a subsurface safety valve in a producing hydrocarbons well, comprising:

providing a self contained control circuitry including a reservoir for a hydraulic fluid;

sensing a drop below a pre-established level of pressure in a flowline distal to the surface safety valve and a drop below a pre-established level of pressure in a portion of a hydraulic circuit fluidly connected to a subsurface safety valve proximal to said subsurface safety valve, and responsive to sensing a drop of said pressure in either said flowline or said circuitry proximal to said subsurface valve:

first draining fluid to said reservoir from a portion of said circuitry means hydraulically maintaining said surface safety valve open, then after a first time delay sufficient for closure of said surface safety valve, secondly draining fluid to said reservoir from a portion of said circuitry means hydraulically maintaining said subsurface safety valve open, and then after a second time delay sufficient for closure of said subsurface safety valve, thirdly isolating said subsurface safety valve at least from said portion of the said circuitry means proximal to said subsurface safety valve.

16. Apparatus for controlling a surface safety valve and a subsurface safety valve in a producing hydrocarbons well, comprising self contained hydraulic circuitry means including (i) a hydraulic reservoir, (ii) hydraulic sensor means for hydraulically sensing a drop below a pre-established level of pressure in a flowline distal to the surface safety valve and a drop below a pre-established level of pressure in a portion of the said circuitry means proximal to a subsurface safety valve, (iii) hydraulic circuitry fluid draining means responsive to said sensor means hydraulically sensing a drop of said pressure in either said flowline or said circuitry proximal to said subsurface valve, to first drain fluid to said reservoir from a portion of said circuitry means hydraulically maintaining said surface safety valve open, then after a time delay sufficient for closure of said surface safety valve, to secondly drain fluid to said reservoir from a portion of said circuitry means hydraulically maintaining said subsurface safety valve open, and (iv) hydraulic circuitry flow restrictor means for imposing said time delay.

17. Self contained apparatus for control of a plurality of safety valves, comprising:

a hydraulic fluid reservoir;

a fluid collection circuit for said reservoir;

a pump for pumping hydraulic fluid from said reservoir;

first and second pilot valves each including a sense port, an inlet port and first and second outlet ports and valve means for fluidly connecting, in a pilot valve first position, both of said outlet ports while blocking said inlet port, or alternatively, in a pilot valve second position, for fluidly connecting said inlet port and said first outlet port while blocking said second outlet port, said second outlet ports of said first and second pilot valves being connected to said fluid collection circuit;

a pilot relay valve including a sense port, an inlet port and first and second outlet ports and valve means for fluidly connecting in a first relay valve position both of said outlet ports while blocking said inlet port, or alternatively for fluidly connecting in a second relay valve position said inlet port and said first outlet port while blocking said second outlet port, said second outlet port of said pilot relay valve being connected to said fluid collection circuit;

a first fluid circuit for fluidly communicating said pump with said inlet ports of said first pilot valve and said first pilot relay valve at a first hydraulic pressure;

a second fluid circuit for fluidly communicating hydraulic pressure from said pump sufficient to open a first safety valve in a first flowline and including a first dump valve the dumping hydraulic fluid from said second fluid circuit into said fluid collection circuit upon actuation of said first dump valve;

a third fluid circuit line in fluid communication with said sense port of said first pilot valve, for fluid connection to said first flowline distal to where said first flowline is valved by said first safety valve;

a fourth fluid circuit for fluidly communicating high pressure from said pump sufficient to open a second safety valve in a second flowline and including both a second dump valve for dumping hydraulic fluid from said fourth fluid circuit into said fluid collection circuit upon actuation of said second dump valve;

a fifth fluid circuit line in fluid communication with said sense port of said second pilot valve, for fluid connection to said second flowline proximal to where said second flowline is valved by said second safety valve;

a sixth fluid circuit fluidly connected to said first outlet port of said pilot relay valve and in fluid communication with said first dump valve for actuating said first dump valve to dump hydraulic fluid from said second fluid circuit into said fluid collection circuit when fluid pressure in said sixth fluid circuit applied to said first dump valve drops below a pre-established level, and;

a seventh fluid circuit in fluid communication with said first outlet port of said pilot relay valve and with said second dump valve for dumping hydraulic fluid from said fourth fluid circuit into said fluid collection circuit if fluid pressure in said seventh fluid circuit applied to said second dump valve drops below a pre-established level

18. The apparatus of claim 17 in which said first safety valve comprises a valve actuator for moving a valve gate between open and closed valve positions within a valve body, said actuator including a pressure chamber having a hydraulic fluid entry port in fluid communication with said second fluid circuit; a piston within said chamber movable in response to pressurized fluid introduced into said chamber through said fluid entry port; a bonnet housing securable to said valve body, said bonnet housing having a bonnet housing bore therethrough; a base ring connected to said bonnet housing in surrounding relationship therewith for securing said operator housing to said bonnet housing; a bonnet stem axially moveable in said bonnet housing bore and securable to said valve gate for moving said valve gate to said open and closed valve positions, said bonnet stem being axially movable in response to movement of said piston with respect to said valve body; a downstop member affixed to said bonnet stem for stopping axial movement of said bonnet stem with respect to said valve body; one or more bonnet stem spacers disposed on said bonnet housing and engageable by said downstop member to stop axial movement of said bonnet stem with respect to said valve body for a selected bonnet stem drift; and a biasing member for producing a biasing force opposing axial movement of said operator member toward said valve body.

19. A method of controlling a surface safety valve and a subsurface safety valve in a producing hydrocarbons well, comprising:

providing a self contained hydraulic control circuitry including a reservoir for a hydraulic fluid, means for hydraulically maintaining a surface safety valve open, means for hydraulically maintaining a subsurface safety valve open, means for hydraulically sensing low pressure in a flowline distal to the surface safety valve, and means for sensing low pressure in a portion of a hydraulic circuit fluidly connected to hydraulically a subsurface safety valve proximal to said subsurface safety valve, and responsive to hydraulically sensing a drop of said pressure in either said flowline or said circuitry proximal to said subsurface valve:

first draining fluid to said reservoir from a portion of said hydraulic control circuitry means hydraulically maintaining said surface safety valve open, and then after a time delay sufficient for closure of said surface safety valve, secondly draining fluid to said reservoir from a portion of said hydraulic control circuitry means hydraulically maintaining said subsurface safety valve open.

* * * * *